US005153952A

United States Patent [19]

Barton et al.

[11] Patent Number: 5,153,952

[45] Date of Patent: Oct. 13, 1992

[54] LATCH ASSEMBLY FOR A CONVERTIBLE SOFA BED

[75] Inventors: Mark S. Barton, Black River Falls; Kurt J. Bandach, Stanley; Mark E. Schlichter, Beloit, all of Wis.

[73] Assignee: August Lotz Co., Inc., Boyd, Wis.

[21] Appl. No.: 863,759

[22] Filed: Apr. 6, 1992

Related U.S. Application Data

[63] Continuation-in-part of Ser. No. 783,682, Oct. 29, 1991.

[51] Int. Cl.[5] ..... A47C 17/17; A47C 17/04

[52] U.S. Cl. ..... 5/47; 5/37.1

[58] Field of Search ..... 5/47, 37.1, 41, 147; 297/354

[56] References Cited

U.S. PATENT DOCUMENTS

| | | | |
|---|---|---|---|
| 835,770 | 11/1906 | Williams . | |
| 2,324,675 | 7/1943 | Burton | 5/37.1 |
| 2,343,642 | 3/1944 | Burton | 5/37.1 |
| 3,634,893 | 1/1972 | Hern et al. | 5/47 |
| 4,829,611 | 5/1989 | Fireman et al. | 5/47 |
| 4,875,244 | 10/1989 | Tremblay | 5/47 |

*Primary Examiner*—Alexander Grosz

*Attorney, Agent, or Firm*—Richard C. Litman

[57] ABSTRACT

A convertible sofa bed which is convertible to provide a sofa or a bed. The convertible sofa bed has a seat which is hinged to a back and supported by a frame. A pivoting pawl, having a bottom end, is attached to the seat near the hinged point. A notch is provided on the back near the hinge which accepts the pawl when the seat is raised. For example, beginning with the convertible sofa bed in the bed position, lift the front of the seat. As the front of the seat is lifted, the gravitational force influences the pawl to hang in a downward direction. The pawl pivots until the bottom end thereof makes contact with the notch. Once the pawl is engaged, the seat is pressed down creating a tension between the notch and the pawl. By continuing to apply leverage to the seat, the back advances upward forming the sofa configuration. To disengage the pawl from the notch, on the front edge of the seat thereby is lifted, relieving the stress on the pawl thus allowing the pawl to freely swing downward disengaging from the notch. The angular configuration of the notch and the congruent relationship between the notch and the pawl provides a unique readily releasable latch configuration.

6 Claims, 4 Drawing Sheets

LATCH ASSEMBLY FOR A CONVERTIBLE SOFA BED

This application is a continuation-in-part of application Ser. No. 07/783,682, filed Oct. 29, 1991.

BACKGROUND OF THE INVENTION

1. Field of the Invention

The present invention relates to a latching assembly for a convertible sofa bed.

2. Description of Prior Art

There exists an apparent appreciation for furniture of the combination type. This appreciation is partially attributed to a need to conserve both space and finances. Economy of space is essential to one who inhabits an area of limited usable space. A single article of furniture capable of functioning in diverse capacities would have the potential to conserve space. Such is the case with convertible furniture. An article of furniture which is capable of being converted from one form to another, each form providing a different utility, offers a reduction in space consumption as compared to a myriad of articles which serving the same number of purposes. Moreover, ones financial resources may confine one to the purchase of a single article. A single piece of furniture capable may not fulfill ones needs. However, a piece of convertible furniture could prove to be capable of fulfilling ones desperate needs as well as render a simple solution to a debate over which item of furniture is most important. It is for these reasons among others that the convertible sofa bed is well known and quite popular.

U.S. Pat. No. 835,770 issued Nov. 13, 1906 to Lawrence Williams shows a convertible couch and bed having a beveled latch releasing device.

U.S. Pat. No. 2,343,642 issued Mar. 7, 1944 to Robert Allen Burton shows pivotally connected seat and back sections of a sofa bed mounted on a bed frame.

U.S. Pat. No. 2,324,675 issued Jul. 20, 1943 to Robert Allen Burton shows a hinge construction for pivotally connecting seat and back sections of a sofa bed.

U.S. Pat. No. 3,634,893 issued Jan. 18, 1972 to John F. Hen et. al. shows a sofa bed assembly which includes a cam rotatably connected to the seat frame for latching and unlatching under the force of gravity the assembly into a sofa or bed position.

U.S. Pat. No. 4,829,611 issued May 16, 1989 to Robert Fireman shows a sofa bed recliner which includes an automatically releasable detent. The detent disclosed in this patent has a flat end which engages the detent perpendicular to the frame of the back.

U.S. Pat. No. 4,875,244 issued Oct. 24, 1989 to Gilles Tremblay shows a sofa bed having a detent interlocking to provide a sofa and releasable to provide a bed.

None of the above inventions and patents, taken either singly or in combination, is seen to described the instant invention as claimed.

SUMMARY OF THE INVENTION

The present invention relates to a convertible sofa bed or the like. The convertible sofa bed includes a seat, a back, and a frame to support both the seat and the back. The seat and back are joined together by axially aligned hinge elements and, in this joined condition, are slidably attached to the frame. The convertible sofa bed provides both right and left readily releasable latch assemblies, each of which includes a pivoting pawl which is engagable and disengagable with a notch. This is accomplished by raising and lowering the seat by a predetermined distance, that is by arcuately pivoting the seat a predetermined distance about the axis of the hinge elements. With the seat and back in a horizontal plane, the convertible sofa bed assumes the status of a bed. To form a sofa, simply raise the front of the seat. The seat pivots on the hinge elements until each pawl engages with its respective notch. A unique congruent configuration exists between each pawl and its respective notch which permits each pawl to engage and disengage with its respective notch with substantially no resistance. The description hereafter describes this unique configuration. The back has an upper edge and a distal end. The distal end in turn has an end face. The notch is located proximate the distal end of the back. A step is inclined inwardly and downwardly to define an acute included angle. A shoulder is located proximate the distal end of the back and is inclined inwardly and downwardly to define an obtuse included angle. The step and the shoulder intersect at a right angle to define the notch. The pawl is substantially rectangular in shape having rear edge and a bottom end. The step and the bottom end of the pawl are substantially of the same cross-section. The pawl is pivotal to congruently engage and disengage with the notch. It is the angular configuration of the notch which permits the pawl to easily engage and disengage with the notch.

Accordingly, one object of the present invention is to provide a convertible sofa bed which alternatively provides a bed arrangement and a sofa arrangement.

Another object of the present invention is to provide a readily releasable latch assembly which supports a distinctive unrestrained latch engagement and disengagement.

A further object of the present invention is to provide a sofa which is substantially effortlessly convertible to a bed and likewise, back to a sofa.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
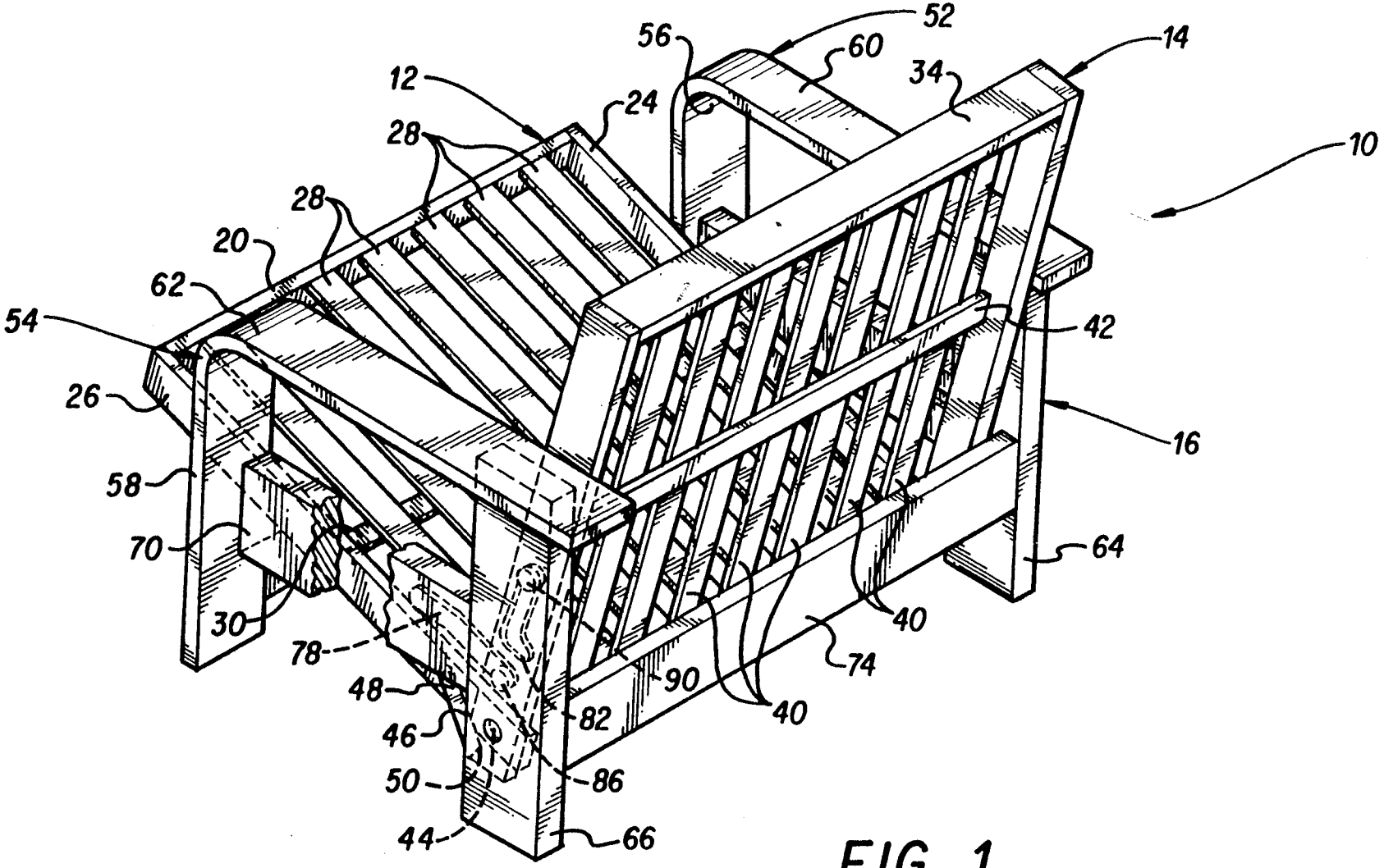
FIG. 1 is a partially broken perspective view of the present invention.

The drawing, referring to FIG. 1, shows the convertible sofa bed 10 in an upright position. The sofa bed 10 includes a seat 12, a back 14, and a frame 16 to support the seat 12 and the back 14.

With reference to FIGS. 1–6, the seat 12 includes a front crossbar 20, a rear crossbar 22, a right side 24, a left side 26, a plurality of slats 28, and a cross brace 30 to provide supplemental support for the slats 28. Similarly, the back 14 includes a front crossbar 32, a rear crossbar 34, a right side 36, a left side 38, a plurality of slats 40, and a cross brace 42 to provide supplemental support for the slats 40. The right and left sides 36,38 of the back 14 proximate the front crossbar 32 overlap the right and left sides 24,26 of the seat 12 proximate the rear crossbar 22, respectively, and are pinned by a dowel 44 to form an unitary pivotal structure.

The frame 16 supports the seat 12 and the back 14. The frame 16 encompasses a right side 52, a left side 54, a right front leg 56, and a left front leg 58. The right front leg 56 and the left front leg 58 are integrally joined to a right armrest 60 and a left armrest 62, respectively. A rear portion of the right armrest 60 is attached to and supported by a right rear leg 64. Likewise, a rear portion of the left armrest 62 is attached to a left rear leg 66. The right and left front legs 56,58 are respectively secured to the right and left rear legs 64,66 by right and left longitudinal supports 68,70, respectively. The right and left sides of the frame 16 are joined together in a spaced apart relation by a front cross support 72. Similarly, the right and left rear legs 64,66 are joined together in a spaced apart relation by a rear cross support 74.

The right and left sides 52,54 of the frame 16 each contain a first track 76,78 and a second track 80,82, respectively. The first tracks 76,78 are each substantially horizontal and the second tracks 80,82 are each substantially vertical. Moreover, the first tracks 76,78 and the second tracks 80,82 are essentially the same length L. The right and left sides 36,38 of the back 14 each have a first peg 84,86 and a second peg 88,90. The first peg 84,86 is engagable in the first track 76,78 and likewise, the second peg 88.90 is engagable in the second track 80,82.

Figure 2:
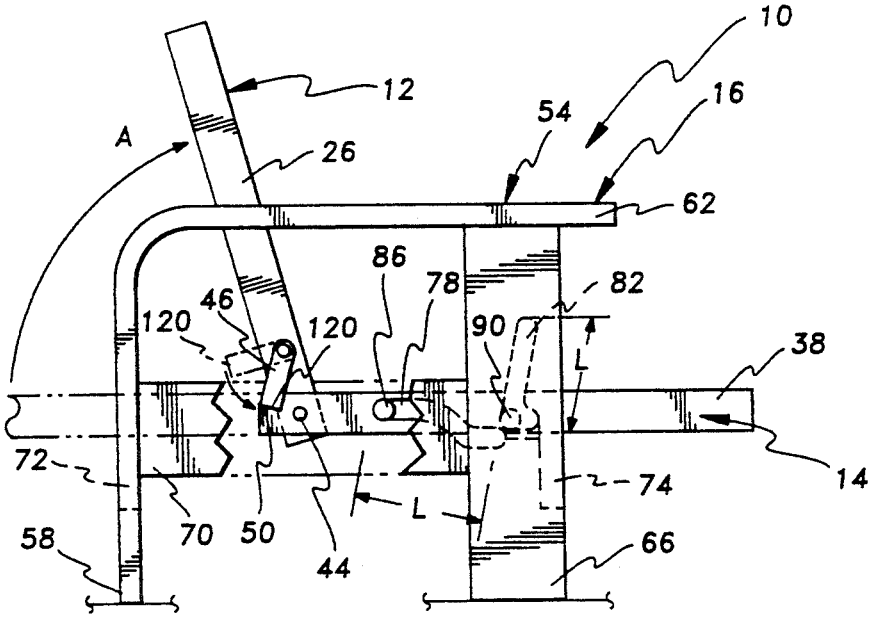
FIG. 2 is a partially broken side elevational view of the present invention showing the seat being raised in phantom to engage the latch assembly.

In FIG. 2, it is shown that the front cross support 72 provides vertical support for the seat 12 when the seat 12 is in a substantially horizontal position or when in a lowered posture. The rear cross support 74 provides vertical support for the back 14 when the back 14 is in a substantially horizontal position or when in a lowered posture. In addition, the first track 76,78 and the second track 80,82 also provide vertical support for the back 14 when the back 14 is in a substantially horizontal position.

The right and left sides 24,26 of the seat 12 each include a pawl 46, adjacent the rear crossbar 22, which pivots on a pin 48. The right and left sides 36,38 of the back 14 each include a step 50 adjacent the front crossbar 32. The pawl 46 is free swinging to engage and to disengage with the step 50 by maneuvering the seat 12 and the back 14, respectively.

Figure 3:
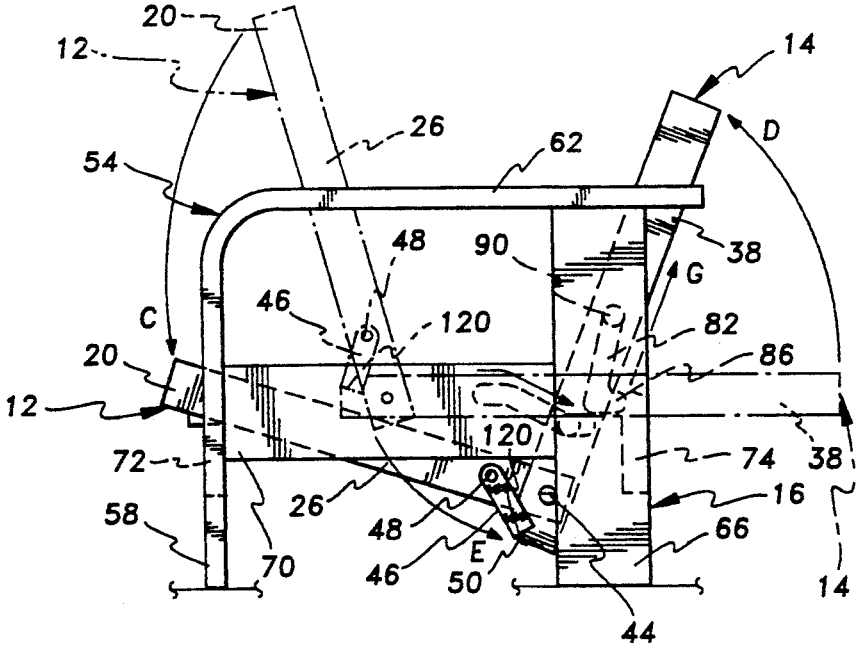
FIG. 3 is a side elevational view of the present invention showing the back being raised as the seat is lowered to form a recliner.
Figure 5:
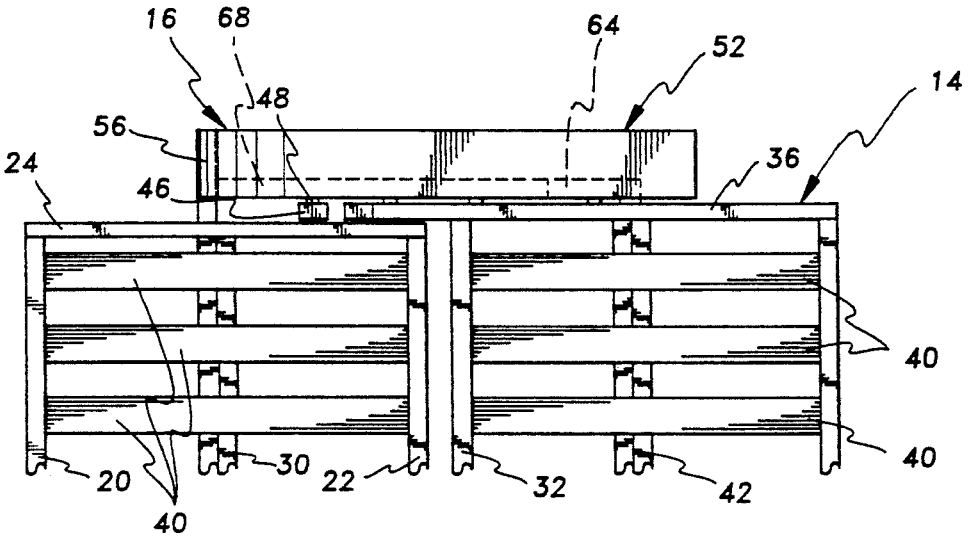
FIG. 5 is a partial top plan of the present invention in the bed position.
Figure 7:
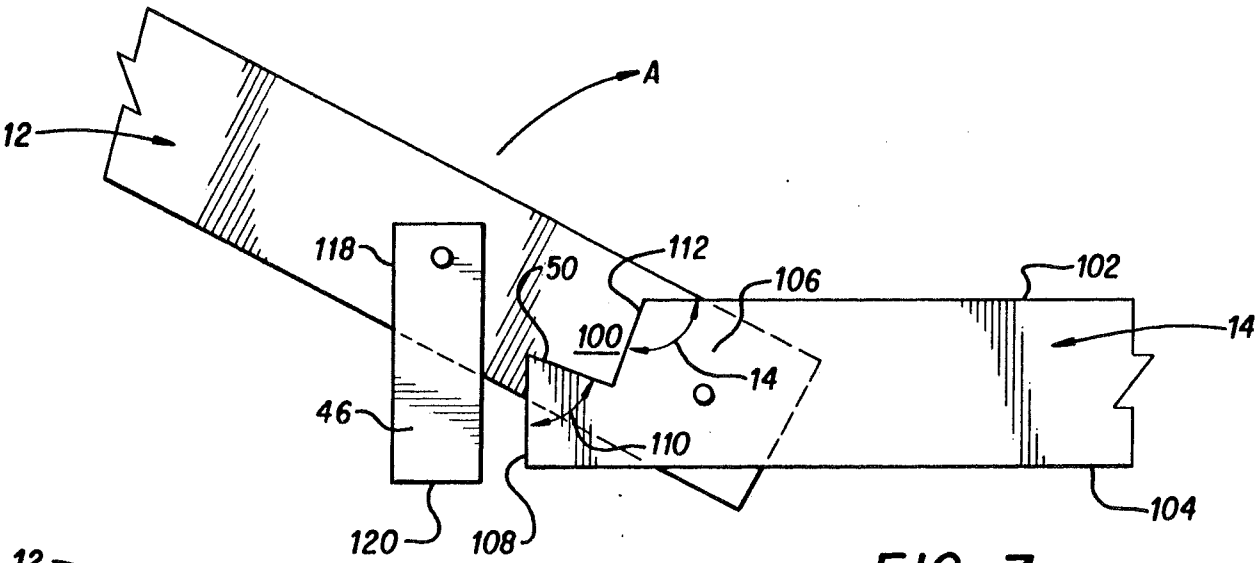
FIG. 7 is a detail view showing the pawl and notch disengaged.
Figure 8:
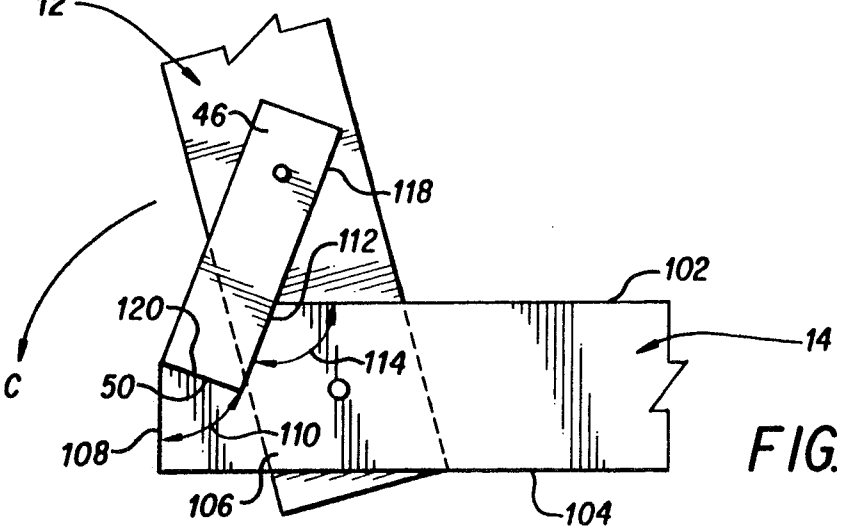
FIG. 8 is a detail view showing the pawl and notch engaged.

As illustrated in FIGS. 2 and 3, when the seat 12 is lifted in the direction A, the pawl 46 swings in the direction B pivoting under the influence of the gravitational force to engage in a notch 100 (referenced in FIGS. 7 and 8). With the pawl 46 engaged in the notch 100, the seat 12 is lowered in the direction C raising the back 14 in the direction D and providing a displacement in the direction E of the hinged area of the seat 12 and the back 14. With the sofa bed 10 in this reclined position, the first peg 84,86 has moved in the direction F to provide both horizontal and vertical support while the second peg 88,90 has moved in the direction G continuing to provide horizontal support.

Figure 4:
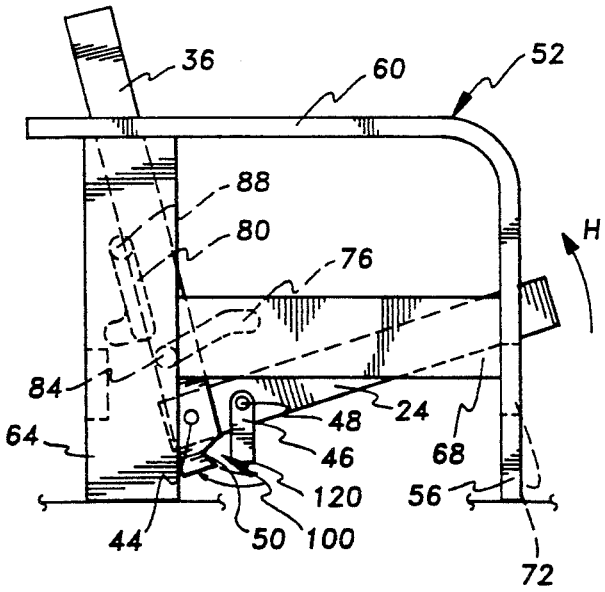
FIG. 4 is a side elevational view of the present invention showing the latch assembly disengaging when the back is moved forward.
Figure 6:
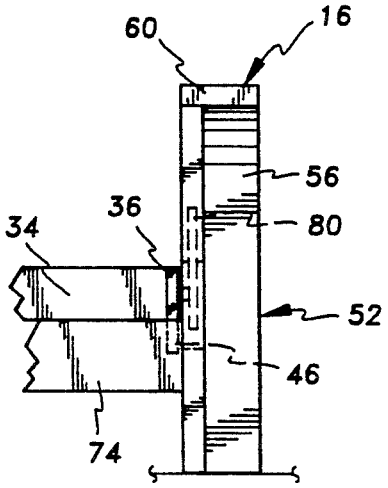
FIG. 6 is a partial rear view of the present invention in the bed position.

FIG. 4 shows how to restore the convertible sofa bed 10 to a bed position. Merely lift the seat 12 up in the direction H. The pawl 46 will disengage from the notch 100 and the back 14 will lower returning the seat 12 and the back 16 to the horizontal position.

Finally, referring to FIGS. 7 and 8, the back 14 has an upper edge 102, a lower edge 104, and a distal end 106. The distal end 106 has an end face 108. The notch 100 is located proximate the distal end 106 of the back 14. The step 50 is inclined inwardly and downwardly to define an acute included angle 110. A shoulder 112 is located proximate the distal end 106 of the back 14 and is inclined inwardly and downwardly to define an obtuse included angle 114. The step 50 and the shoulder 112 intersect at a right angle to define the notch 100. The pawl 46 is substantially rectangular in shape having rear edge 118 and a bottom end 120. The pawl 46 is pivotal to engage congruently with the notch 100 when the seat 12 is raised in the direction A and is maintained in this engaged posture by lowering the seat 12 in the direction C. By the same token, it is shown that the pawl 46 is disengaged from the notch 100 simply by raising the seat 12 in the direction H (as shown in FIG. 4). It is this unique congruent configuration between the pawl 46 and the notch 100 which permits the pawl 46 and the notch 100 to easily engage and disengage.

It is to be understood that the present invention is not limited to the sole embodiment described above, but encompasses any and all embodiments within the scope of the following claims.

We claim:

1. A convertible sofa bed comprising:

a seat having a left side, a right side, and a proximal end, a back having a left side, a right side, and a distal end, said left side and said right side each include an upper edge and a lower edge, and said distal end includes an end face, means to join said seat and said back, said means to join providing a pivotal joint adjoining said seat and said back, a frame which supports said seat and said back, means to slidably attach said seat and said back to said frame, a left pivotal pawl and a right pivotal pawl, both being substantially rectangular in shape, pivotally attached to said left side of said back and said right side of said back, respectively, said left and right pivotal pawls being located proximate said proximal end of said seat, a left step intersecting at substantially a right angle with a left shoulder defining a left notch and a right step intersecting at substantially a right angle with a right shoulder defining a right notch, said left and right notches being located respectively on said left and right sides of said back adjacent said distal end thereof, said step further being inclined inwardly and downwardly to define an acute included angle and said shoulder being further inclined inwardly and downwardly to define an obtuse included angle, said pivotal pawl being engageable and disengagable with said notch to form an alternative sofa and bed, whereby when said convertible sofa bed is in a bed position, said seat is lifted to engage said pivotal pawl with said step and thereafter lowering said seat is lowered to raise the back thereby form a sofa and when said convertible sofa bed is in a sofa position the seat is thereafter slightly lifted to disengage said readily releasable latch with substantially no resistance, said seat and back may be lowered to form said bed.

2. The device according to claim 1, wherein said seat and said back each further include:

a front cross bar and a rear cross bar joined at right angles to said right side and said left side to form an outer periphery, a plurality to slats each having first and second ends, each one of said first ends being attached perpendicular to said front cross brace in a spaced apart relation and each one of said second ends being attached perpendicular to said rear cross bar in a spaced apart relation, said plurality of slats provide a supporting surface for a user, and a cross brace having a first end and a second end, said first end being attached perpendicular to said right side and said second end being attached perpendicular to said left side such that said cross brace is juxtaposed to a bottom surface of said plurality of slats, said cross brace provides supplemental support for said plurality of slats.

3. The device according to claim 2, wherein said distal end of said right side of said back is pinned by a right dowel to said proximal end of said right side of said seat such that said distal end of said right side of said back overlaps said proximal end of said right side of said seat and said distal end of said left side of said back is pinned by a left dowel to said proximal end of said left side of said seat such that said distal end of said left side of said back overlaps said proximal end of said left side of said seat to form a unitary pivotal structure, said right and left dowels combined to form said means to join said seat and said back.

4. The device according to claim 3, wherein said right and left dowels are axially aligned.

5. The device according to claim 2, wherein said frame includes a right and a left side each comprising an armrest having a front and rear end, said front end of each said armrest being integrally joined to a front leg substantially at a right angle, said rear end of each said armrest being joined substantially at a right angle to a rear leg, and each said side of said frame further including a longitudinal support being joined substantially perpendicular to said front leg and extending and being joined substantially perpendicular to said rear leg to add structural integrity to said frame, said right side of said frame and said left side of said frame each having a front and a rear end joined together respectively by a front and rear cross support each having two ends, one of said ends of said cross support being attached perpendicular to said right side of said frame and one of said ends of said cross support being attached perpendicular to said left side of said frame, said cross supports extending from said right side of said frame to said left side of said frame whereby said front cross support of said frame also providing vertical support for said seat and said rear cross support of said frame also providing vertical support for said back.

6. The device according to claim 5, wherein said right side and said left side of said frame each include a first and second track, said first track is substantially horizontal and said second track is substantially vertical and said right side and said left side of said back include a first and second peg which mate respectively with said first and second track providing said means to slidably attach said seat and said back to said frame whereby said first track provides continuous vertical support for said seat and said second track provides vertical support for said back when said back is in a horizontal position.

* * * * *